US006753653B2

(12) United States Patent
Wendt

(10) Patent No.: US 6,753,653 B2
(45) Date of Patent: Jun. 22, 2004

(54) PLASMA DISPLAY SCREEN

(75) Inventor: Matthias Wendt, Wuerselen (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 269 days.

(21) Appl. No.: 10/014,240

(22) Filed: Dec. 11, 2001

(65) Prior Publication Data

US 2002/0070907 A1 Jun. 13, 2002

(30) Foreign Application Priority Data

Dec. 12, 2000 (DE) ..... 100 61 722

(51) Int. Cl.[7] ..... G09G 3/00
(52) U.S. Cl. ..... 315/161; 315/169.3
(58) Field of Search ..... 315/169.3, 169.1, 315/169.4, 160, 161; 174/52.4, 94 R, 80

(56) References Cited

U.S. PATENT DOCUMENTS 4,985,663 A * 1/1991 Nakatani ..... 315/169.3
5,952,986 A 9/1999 Nguyen et al. ..... 345/68

FOREIGN PATENT DOCUMENTS

| | | |
|---|---|---|
| JP | 09062226 A | 3/1997 |
| JP | 11041545 A | 2/1999 |
| JP | 200005670 | 2/2000 |
| WO | 000470753 | 5/1993 |

* cited by examiner

*Primary Examiner*—David Vu

(57) ABSTRACT

The present invention relates to an arrangement including a plasma display screen (3). In such an arrangement having cells for the generation of pixels between a transparent front plate (10) facing the viewer and a rear wall (11) and having electrical contacts for contacting the cells in the areas (13) of opposite outer edges of the rear wall (11), which contacts are connected to electronic circuits (4, 6, 7), arranged on the outer side of the rear wall (11) remote from the cells, by way of current supply leads (2) which extend substantially parallel, in such a manner that the current supply leads (2) end, electrically isolated, in a narrow contact area (14), where electrical contact is established between the current supply leads (2), on the one hand, and the electrical circuits (4, 6, 7), on the other hand.

5 Claims, 4 Drawing Sheets

PLASMA DISPLAY SCREEN

Figure 1:
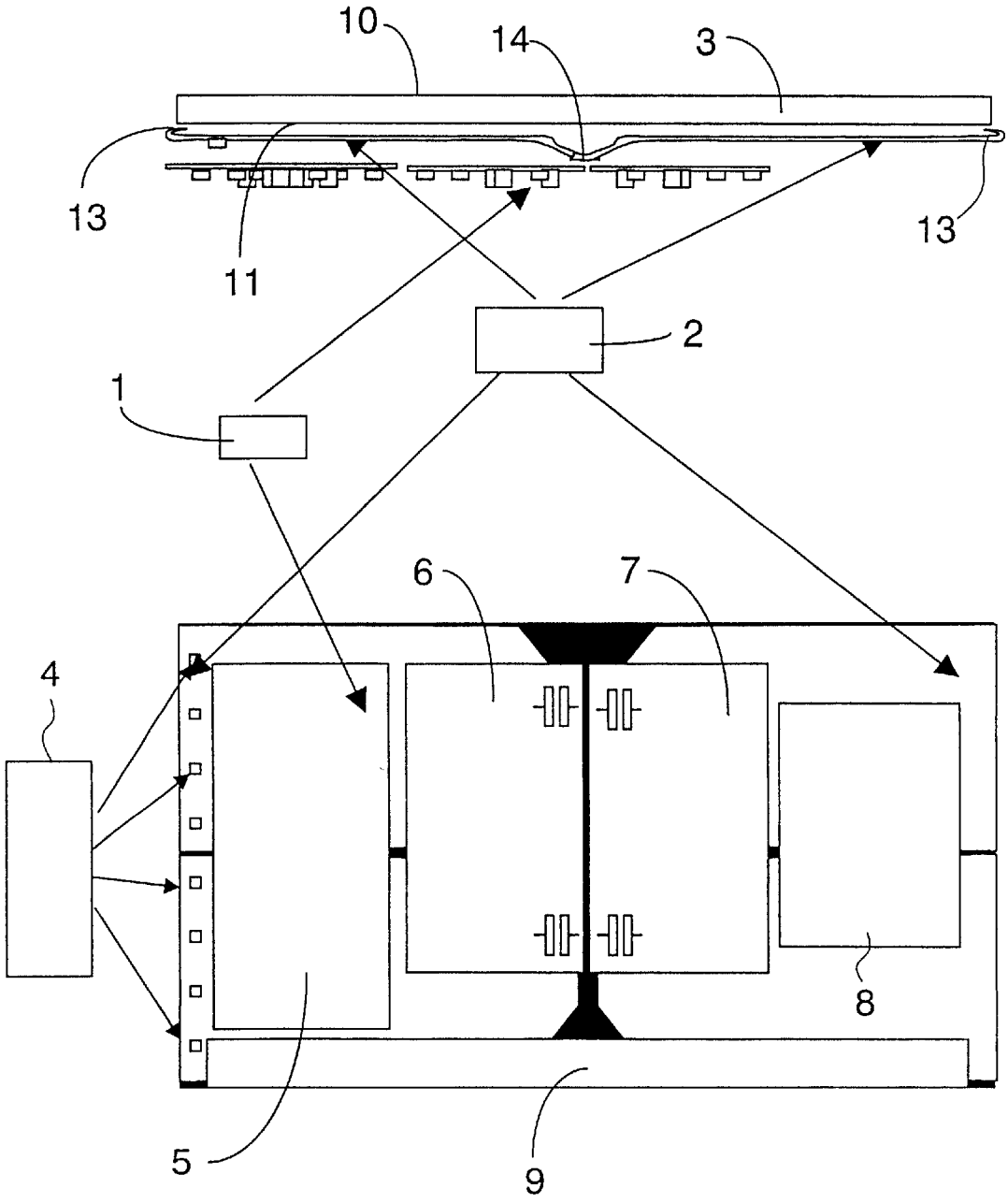

The present invention relates to an arrangement including a plasma display screen.

Currently marketed television sets having plasma display screens require a substantial investment as regards the shielding of electromagnetic fields. They require inter alia a solid aluminum or metal housing in combination with a metal-coated front plate in order to enable the statutory requirements as regards electromagnetic compatibility to be met. These shielding measures are expensive and, moreover, they increase the weight of the sets.

It is an object of the present invention to improve the circuits and power leads for driving such a plasma display screen in such a manner that the emission of electromagnetic waves is reduced and additional shielding measures are superfluous.

According to the invention the object is achieved in a first manner in that in an arrangement including a plasma display screen having cells for the generation of pixels between a transparent plate facing the viewer and a rear wall and having electrical contacts for contacting the cells in the areas of opposite outer edges of the rear wall, which contacts are connected to electronic circuits, arranged on the outer side of the rear wall which faces the cells, by means of current supply leads which extend substantially parallel, in such a manner that the current supply leads end, electrically isolated, in a narrow contact area, where electrical contact is established between the current supply leads, on the one hand, and the electrical circuits, on the other hand.

Thus, by a modified arrangement of the circuits for driving the plasma display screen, the current routing between the display boards and the electrodes of the pixels of the display screen is changed in such a manner that the emission is reduced. For this purpose, the current supply leads to the connections of the electrodes of the plasma display screen are not only present in the peripheral areas, as customary until now, but they are present over the entire back side of the plasma display screen and end, coming from both sides, in a narrow contact area, which extends perpendicularly to the current supply leads. This area of the plasma display screen precludes an antenna-like emission of electromagnetic fields, because the current supply leads coming from both sides end, electrically isolated, directly adjacent one another. Moreover, as a result of such an arrangement the electromagnetic fields emitted by the current supply leads to the electrodes on principle combine with the fields emitted by the current supply leads that extend on the inner side of the rear wall and cancel one another in the ideal case. Thus, an expensive and weight-increasing shielding as in conventional plasma display screens is superfluous. Since both the connections for the electrodes disposed on the front plate and for the electrodes disposed on the rear wall can be led out and arranged at the periphery of the rear wall, this enables all the electrodes to be connected to the current supply leads and to be led to the contact area.

By means of a printed conductive connection as defined in claim 2 the current supply leads can be manufactured cost-effectively and simply from the point of view of production engineering, in that they are deposited on the rear of the plasma display screen.

The embodiment as defined in claim 3 enables the use of the known connections via flexible leads to be continued in order to obtain a shielding in accordance with the invention as defined in claim 1.

The present object is achieved in a second manner with the aid of the subject matter of claim 4. Thus, the current paths to the contact areas of the electrodes can also be shortened in that the circuits for driving the pixels are arranged directly on the outer side of the rear wall of a plasma display screen. This once again shortens leads to the electrode connections. Moreover, common buffer capacitors shorten the current paths between the electronic circuits for the driver stages of the X electrodes and the Y electrodes. In combination with the embodiment as defined in claim 1 this enables a particularly effective suppression of the emission of electromagnetic waves. At the same time, a solution using common buffer capacitors is substantially cheaper than one using separate buffer capacitors for each driver stage.

With the embodiment as defined in claim 5 the advantages of the invention are obtained in an end product such as a television set or a monitor, which can consequently be manufactured more cheaply.

Figure 2:
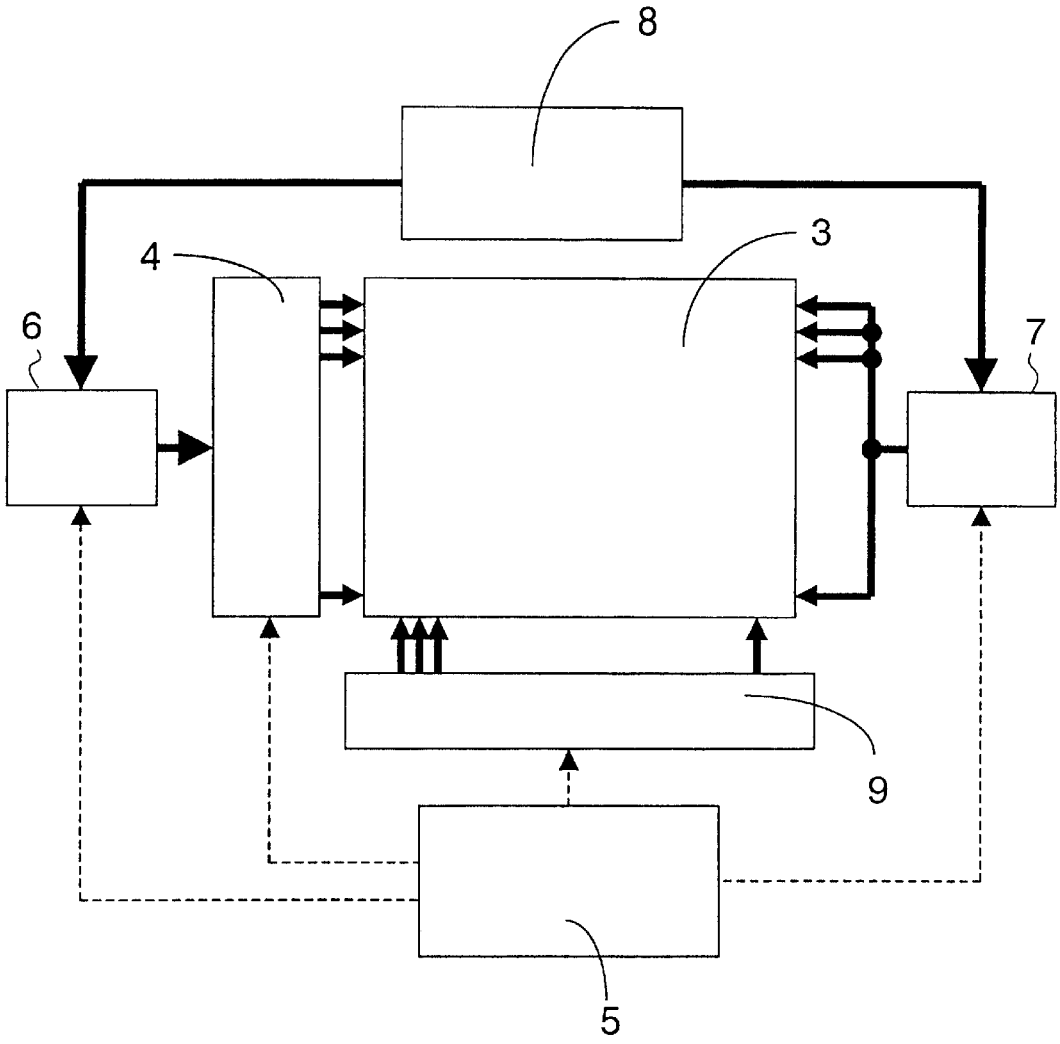
Figure 3:
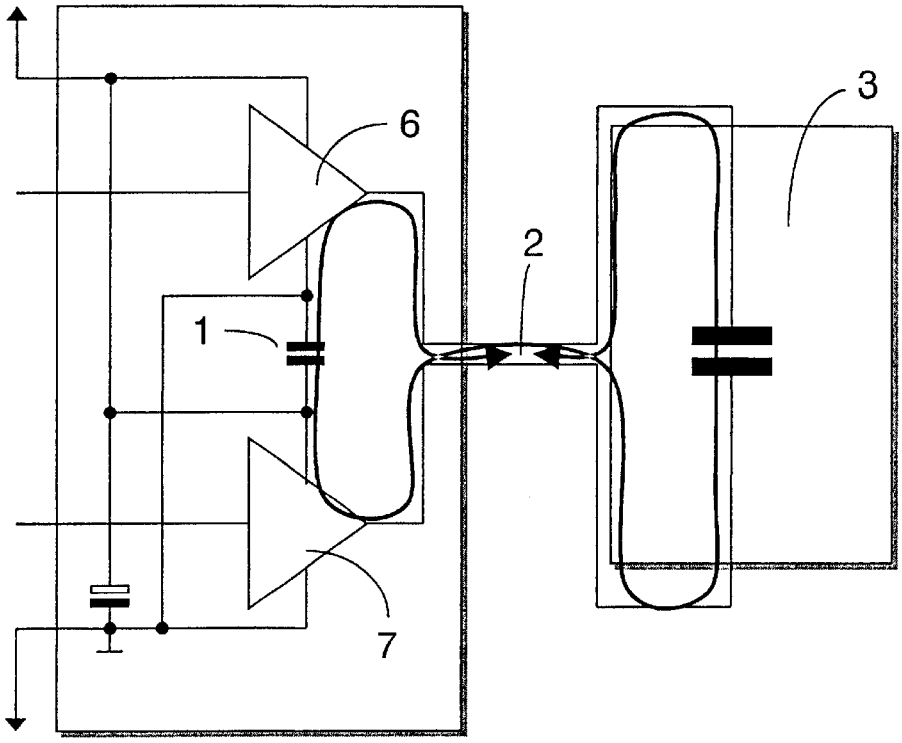
Figure 4A:
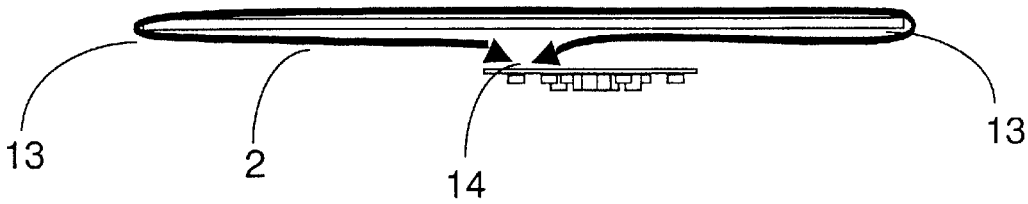
Figure 4B:
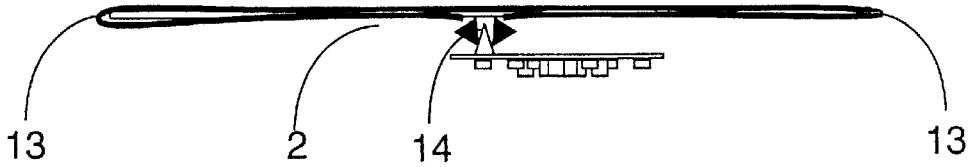
Figure 5:
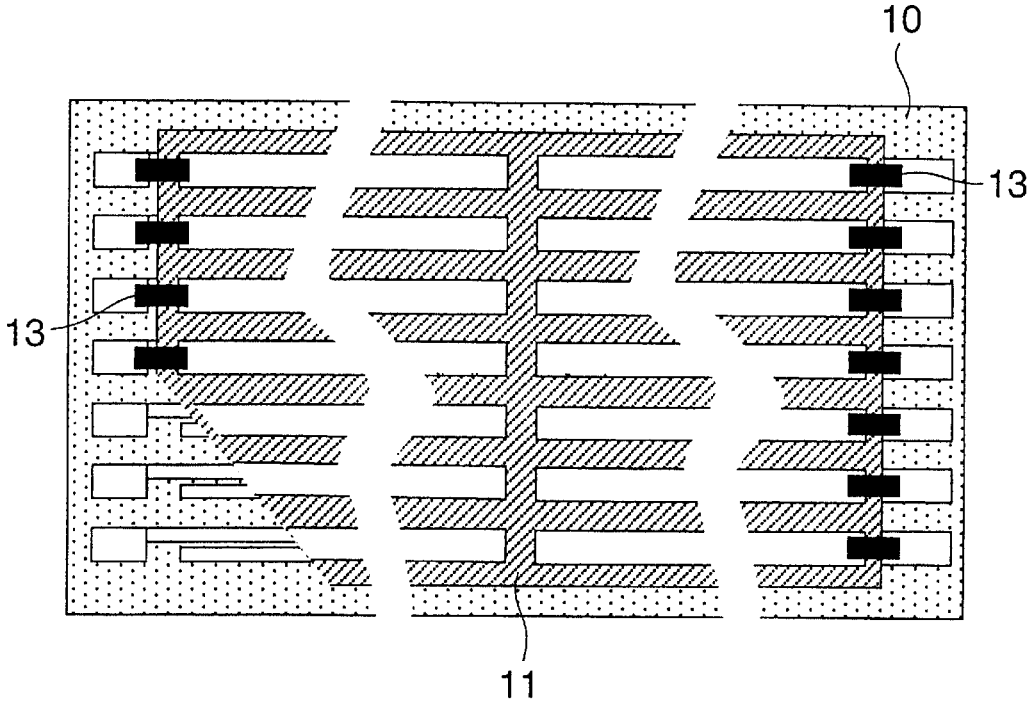
Figure 6:
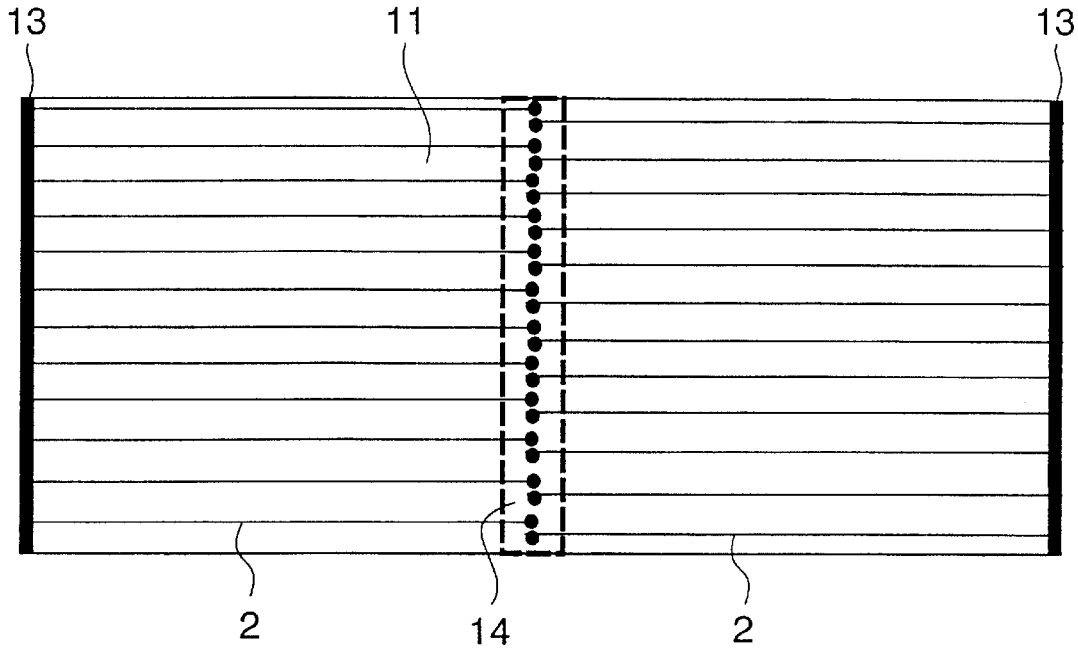

Embodiments of the invention will be described in more detail with reference to the drawings. In the drawings:

FIG. 1 diagrammatically shows the individual parts of a plasma display screen, FIG. 2 is a block diagram of a conventional plasma display screen, in which the current routings are shown, FIG. 3 shows a plasma display screen having a common circuit board for the two X/Y driver stages with a central connection of the current supply leads to the electrodes of the plasma display screen, FIG. 4*a* shows the conventional current routing at the rear of a plasma display screen, FIG. 4*b* shows the improved current routing at the rear of a plasma display screen, FIG. 5 shows the novel arrangement of the current supply leads of the X/Y front electrodes to the contact area at the rear of a plasma display screen, and FIG. 6 is a plan view of the rear of a plasma display screen having current supply leads in accordance with the invention.

As is shown in FIG. 1, an arrangement in accordance with the invention above all consists of the actual plasma display screen 3, on whose rear side current supply leads 2 are arranged, which connect the plasma display screen 3 to the electronic circuits for driving the pixels of the plasma display screen 3. The electronic circuits inter alia include the two driver stages 6, 7, which drive the two different electrode groups, i.e. the X electrodes and the Y electrodes. The driver stages receive their currents from a power supply module 8, for example a switched-mode power supply. By means of further circuits 4, 9 the pixels are selected, the circuit 4 selecting the rows of the plasma display screen 3 and the circuit 9 selecting the columns. The selection of the pixels is effected by the two circuits 4, 9 in dependence on the applied picture information. This information is provided by a circuit 5 for picture processing.

When a pixel is driven, the pixel lights up and comparatively large currents having, above all, high frequencies flow through the electrodes and the current supply leads 2 as well as the current supply leads between the contacts 13 and the individual electrodes of the pixels. The current-carrying connections emit electromagnetic waves. In FIG. 2 these are shown as heavy black lines, while the broken lines represent only weak currents whose electromagnetic fields are negligible. The large currents together with the associated return currents cover an area, a large area meaning a high electromagnetic emission. Therefore, these areas are reduced by means of the present invention, in such a manner that the electromagnetic fields of the applied currents and of the return currents compensate for one another to a maximal extent. At a certain distance from the plasma display screen 3 the fields subsequently cancel one another. In addition, the contact of the current supply leads 2 to the driver stages 6, 6 are made in a very narrow contact area 14. As a result of this, the end portions of the current supply leads 2, which come from both sides, cannot act as antennas and emit electromagnetic waves. The best result is therefore obtained when the current supply leads end, electrically insulated with respect to one another, directly adjacent one another. This is shown in FIG. 6. The contact area 14 may then be off-centered but it is important that this contact area extends transversely over the entire width of the rear wall 11 transversely to the current supply leads 2.

For a particularly small emission area the current supply leads 2 are deposited directly on the rear side of the rear wall 11 as a conductive coating. The rear wall 11 is currently made of glass for reasons of static charges but it may be made of any other temperature-resistant material because it need not be transparent, which is even undesirable because this also allows the passage of light from the pixels towards the rear.

The principal advantage is thus obtained by the new arrangement of the current supply leads 2. While in conventional plasma display screens the driver stages 6, 7 for the X and Y electrodes are accommodated on separate circuit boards and in the case of voltage transitions the current are fed via the ground return, the arrangement in accordance with the invention does not use such a current flow via the ground return path. Furthermore, the driver boards 6, 7 are arranged centrally and connected to the X/Y electrodes via current supply leads 2. This can be achieved in that, as in FIG. 2, the current supply leads 2 (in the present case flexible leads) for the X/Y electrodes are led to the center of the plasma display screen 3 at the rear of this screen. At this location they are connected to the driver stages 6, 7 by means of separate connectors.

In order to shorten the current paths even further it is useful to accommodate the driver stages 6, 7 on a common circuit board. This is illustrated in FIG. 3. This reduces the emission of electromagnetic waves as a result of cross-over currents between the driver stages 6, 7. Moreover, the current supply leads 2 for the X/Y electrodes can now be connected to the driver stages 6, 7 via a common connector. Furthermore, the two driver stages 6, 7 can employ common buffer capacitors 1, which enables the number of capacitors to be halved.

A further improvement is possible in that the circuit 4 for the row selection is no longer arranged on the flexible leads forming the current supply leads 2 but directly on the rear wall 11 of the plasma display screen 3. The current supply leads 2 between Y electrodes and the circuit 4 for row selection as well as their connections to the X/Y driver stages 6, 7 can then be realized by a conductive layer on the rear wall 11 of the plasma display screen 3, as shown in FIG. 4*b*; FIG. 4*a* shows the conventional leads 2. The connection of the plasma display screen 3 to the driver stages 6, 7 can be made in a cost-effective manner by means of connectors and contact springs or other conductive flexible materials which are in direct contact with the conductive layer of the current supply leads 2. Apart from the reduction of the emission area such an arrangement has the advantage of an increased magnetic coupling, which improves the current distribution of the return currents.

When the emission area of the entire arrangement is viewed from the glass plate 10 at the front of the plasma display screen 3, this area is minimized when the contact area extends over the entire vertical center line of the plasma display screen 3. The currents are then not concentrated towards the contact locations. For this purpose, the current supply leads 2 of each individual X electrode and each individual Y electrode on the glass front plate 10 are separately led towards the rear to the outer side of the glass rear plate 11 of the plasma display screen 3 and from there to approximately the center, where they are brought into contact with the electronic circuits (driver stages) 4, 6, 7. This is effected with a narrow contact area 14 over the entire width in the same way as in the embodiment defined in claim 1, shown in FIG. 6. The stage for driving the rows can then also be accommodated on a common circuit board together with the X/Y driver stages. This embodiment is shown in FIG. 5.

It is obvious that instead of the glass front plate 10 a transparent plastic plate or foil may be used if the stability of the entire plasma display screen 3 is assured.

What is claimed is:

1. An arrangement including a plasma display screen (3) having cells for the generation of pixels between a transparent front plate (10) facing the viewer and a rear wall (11) and having electrical contacts for contacting the cells in the areas (13) of opposite outer edges of the rear wall (11), which contacts are connected to electronic circuits (4, 6, 7), arranged on the outer side of the rear wall (11) remote from the cells, by means of current supply leads (2) which extend substantially parallel, in such a manner that the current supply leads (2) end, electrically isolated, in a narrow contact area (14), where electrical contact is established between the current supply leads (2), on the one hand, and the electronic circuits (4, 6, 7), on the other hand.

2. An arrangement as claimed in claim 1,
characterized in that the current supply leads (2) take the form of conductor tracks deposited on the outer side of the rear wall (11), which outer side is remote from the cells.

3. An arrangement as claimed in claim 1,
characterized in that the current supply leads (2) take the form of cables.

4. An arrangement as claimed in claim 1,
characterized in that this arrangement is a television set or monitor.

5. An arrangement including a plasma display screen (3), having cells for the generation of pixels between a transparent front plate (10) facing the viewer and a rear wall (11) and having electronic circuits (4, 6, 7) arranged on the outer side of the rear wall (11) remote from the cells, for driving X electrodes (6), Y electrodes (7) and the rows (4), which circuits are mounted directly on the surface of the outer side of the rear wall (11) of the plasma display screen (3) remote from the cells and including common buffer capacitors (1) for the electronic circuits for driving X electrodes (6) and Y electrodes (7).

* * * * *